US005495806A

United States Patent [19]

Willey

[11] Patent Number: 5,495,806

[45] Date of Patent: Mar. 5, 1996

[54] DETONATORS

[75] Inventor: Christopher A. Willey, Johannesburg, South Africa

[73] Assignee: Altech Industries (Proprietary) Limited, Boksburg, South Africa

[21] Appl. No.: 310,784

[22] Filed: Sep. 27, 1994

[51] Int. Cl.[6] ..... F42C 19/02; F42C 19/08

[52] U.S. Cl. ..... 102/202.14; 102/202.5; 102/202.9

[58] Field of Search ..... 102/202.5, 202.9, 102/202.11, 202.14

[56] References Cited

U.S. PATENT DOCUMENTS

| | | | |
|---|---|---|---|
| 3,683,811 | 8/1972 | Driscoll | 102/202.13 |
| 3,763,782 | 10/1973 | Bendler et al. | 102/202.9 |
| 4,103,619 | 8/1978 | Fletcher et al. | 102/28 R |
| 4,316,412 | 2/1982 | Dinegar et al. | 102/202.5 |
| 4,393,779 | 7/1983 | Brede et al. | 102/202.5 |
| 4,402,269 | 9/1983 | Smith | 102/202.13 |
| 4,586,435 | 5/1986 | Bock | 102/202.5 |
| 4,616,565 | 10/1986 | Reinovsky | 102/202.7 |
| 4,648,319 | 3/1987 | Westerlund et al. | 102/202.12 |
| 4,727,808 | 3/1988 | Wang et al. | 102/202.5 |
| 4,735,145 | 4/1988 | Johnson et al. | 102/202.5 |
| 4,869,170 | 9/1989 | Dahmberg et al. | 102/202.5 |
| 4,939,993 | 7/1990 | Curutchet et al. | 102/202.14 |
| 4,944,225 | 7/1990 | Barker | 102/202.5 |
| 4,956,029 | 9/1990 | Hagel et al. | 149/19.8 |
| 5,046,425 | 9/1991 | Gibbons, Jr. et al. | 102/293 |
| 5,054,395 | 10/1991 | Vetter | 102/202.3 |
| 5,088,412 | 2/1992 | Patrichi | 102/202.13 |
| 5,088,413 | 2/1992 | Huber et al. | 102/202.5 |
| 5,099,762 | 3/1992 | Drapala | 102/202.1 |
| 5,140,906 | 8/1992 | Little, II | 102/202.14 |
| 5,142,982 | 9/1992 | Diepold et al. | 102/202.5 |
| 5,204,491 | 4/1993 | Auréal et al. | 102/202.14 |
| 5,230,287 | 7/1993 | Arell, Jr. et al. | 102/202.5 |
| 5,345,872 | 9/1994 | Takahashi et al. | 102/202.2 |
| 5,423,261 | 6/1995 | Bernardy et al. | 102/202.14 |

FOREIGN PATENT DOCUMENTS

| | | | |
|---|---|---|---|
| 0960186 | 6/1964 | United Kingdom | 102/202.9 |

*Primary Examiner*—Charles T. Jordan
*Assistant Examiner*—Christopher K. Montgomery
*Attorney, Agent, or Firm*—Jacobson, Price, Holman & Stern

[57] ABSTRACT

A detonator has a transparent polycarbonate tubular casing, with an electric igniter inserted from one end to abut a constriction in the tube. The conflagration charge is deposited onto the igniter from the other tube end, and primary and secondary explosive charges respectively are added from that other end.

20 Claims, 1 Drawing Sheet

DETONATORS

INTRODUCTION

This invention relates to a detonator, a method of assembly of a detonator and an electric igniter more particularly, but not exclusively, for initiating explosive charges in mining operations.

BACKGROUND TO THE INVENTION

Electronically controlled detonators are well known in the art. Such detonators usually consist of one or more explosive charges and a miniature electronic fuse which can be either heat-producing or shock wave-producing.

These type of electronic detonators have a disadvantage in that the interfacing of miniature electronic fuses and explosive devices is a difficult operation to perform accurately, and can result in the production of batches of detonators with significantly differing operating characteristics. This is undesirable since detonators having inconsistent characteristics can be dangerous.

The standard method of assemblying a detonator is to load the secondary charge down a blind tubular casing, followed by a primary charge and the initiating charge. This means that the most dangerous charge is present during assembly of the detonator.

OBJECT OF THE INVENTION

It is an object of this invention to provide a detonator, a method of assembly of a detonator, and an electric igniter, which will, at least partially, alleviate the abovementioned difficulties.

SUMMARY OF THE INVENTION

In accordance with this invention there is provided a method of assembling a detonator comprising: fitting an electric igniter in a tubular body having first and second ends, with at least the first end being open; and locating at least one explosive charge in operative proximity to the electric igniter by insertion thereof through the first tubular end opening.

Preferably the electric igniter has an ignition area and the electric igniter is fitted to locate the ignition area to be accessible from the first end, a conflagration charge being deposited from the first end onto the ignition area of the electric igniter prior to the location of the said at least one explosive charge.

Further preferably a primary explosive charge is first located in operative proximity to the conflagration charge by insertion thereof through the first end, and a secondary explosive charge is located in operative proximity to the primary explosive charge within a tubular extension of the said first end.

There is provided for the second end to be open and the electric igniter to be fitted by insertion thereof from the second end.

The electric igniter is preferably fitted to abut against a constriction in the tube diameter towards the first end, and the conflagration charge is located by the deposition thereof in liquid form, with the spread of the liquid conflagration charge being contained within the ignition area by use of a containment means therearound.

The containment means used is preferably a "vee" section channel in the surface of the electric igniter around the ignition area, and the first end is sealed after location of the secondary charge.

The sealing is optionally achieved by means of an end cap fixed over a protruding nozzle forming part of the tube constriction.

In this case, the end cap may form the tubular extension of the first end, and the secondary explosive charge is located therein prior to fixing of the end cap over the nozzle.

The invention also provides a detonator comprising a generally tubular body having an insertion end giving access to the interior of the body, an electric igniter with a conflagration charge, located in the interior of the tube, at least one explosive charge operatively located between the electric igniter and the insertion end of the body, and, an end piece closing off the insertion end.

Preferably there is a primary charge operatively located next to the electric igniter, and a secondary charge operatively located between the primary charge and the end piece.

Further preferably the tubular body has another closable end through which the electric igniter is insertable prior to closure of this end.

There is provided for the tubular body to have a constriction spaced from the insertion end, against which the electric igniter abuts in operative inserted position. The constriction is generally concentric with the tubular interior of the body, and extends from the abutment position of the electric igniter to form the insertion end.

The primary explosive charge is preferably located within the constriction.

An end cap is fixed over the constriction to act as the end piece, the end cap having a tubular body which when operatively fixed extends the tubular housing, and which houses the secondary explosive charge.

Fully assembled, the detonator includes electronic circuitry located within the tubular body to extend from the position of the electric igniter towards said other closable end.

There is particularly provided for the tubular body to be a plastic material, for the end piece also to be a plastics material, for the plastics material is polycarbonate, and for the plastics material to be at least translucent, and preferably transparent.

The electric igniter comprises a base having spaced apart electrically conductive areas on a first surface, and a hole leading from each area to another surface, each hole being at least partially plated through with electrically conductive material to be electrically connected to its respective area.

In the preferred form of the electric igniter, each hole leads to a common other surface, the base is disc shaped with opposing major surfaces, one major surface being the said first surface and the other major surface being the said common surface.

Particularly there is provided for the conductive areas to be formed by printing conductive ink on the first surface, and for the through plating to be achieved by applying a vacuum to the hole at the other surfaces, to draw ink down and coat the sides of the holes.

The printing may be achieved by screen printing.

The disc is preferably glass filled poly-butylene terephthalate and there is provided for a resistive bridge connecting the conductive areas.

Preferably there is containment means on the first surface surrounding both conductive areas to define an enclosed containment area, the containment means being arranged to contain flowable charge substance within the area, when the charge substance is deposited thereon from overhead in use.

The containment means may be formed by a groove in the first surface which defines the containment area, the groove dimensions being selected to cause sufficient surface tension in the flowable charge substance to halt the flow thereof in use at the groove position.

The groove preferably has a "vee" shaped section.

The invention extends to a tubular body adapted for use in a detonator as above defined, and to an end piece and an electric igniter separately and apart from each other, each adapted for use in a detonator as above defined.

BRIEF DESCRIPTION OF THE DRAWINGS

One embodiment of the invention is described below, by way of example only, and with reference to the accompanying drawing which is a sectional elevation of a detonator.

DETAILED DESCRIPTION OF THE DRAWINGS

Figure 1:
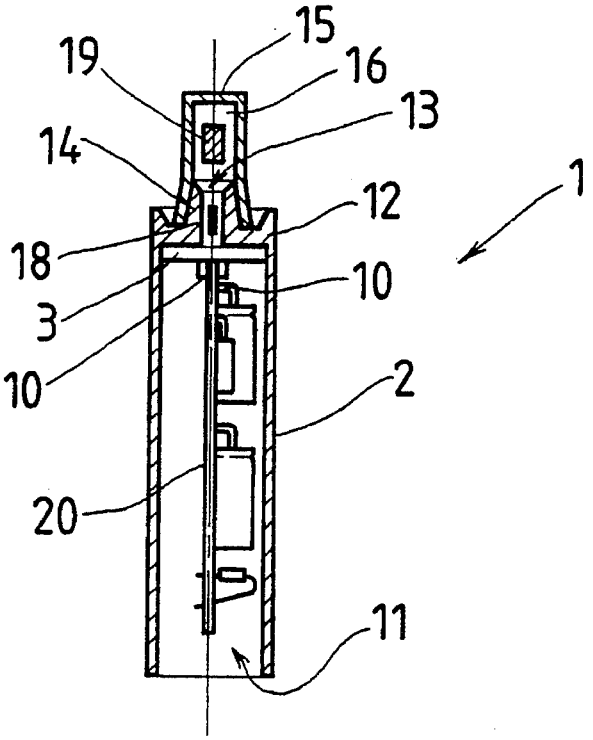
FIG. 1 is a side elevation of the detonator.
Figure 2:
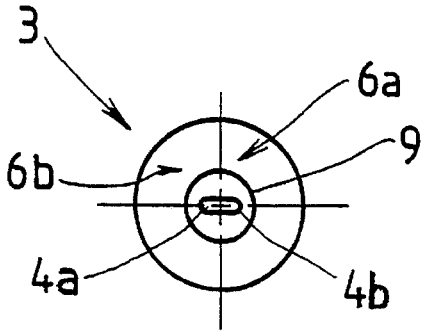
FIG. 2 is a top view of the detonator plug.
Figure 3:
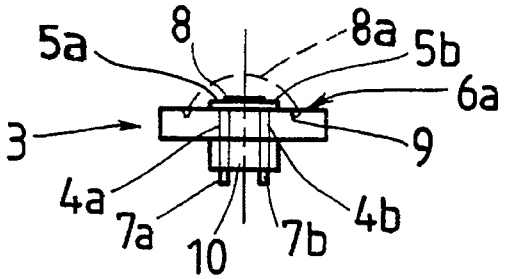
FIG. 3 is a side view of the detonator plug.

Referring to the drawings, a detonator is indicated generally by reference numeral (1).

The detonator (1) comprises a hollow cylindrical tube (2) which is made, preferably, of a polycarbonate plastics material, which is also preferably transparent. A plug (3) in the shape of a molded disk is wedged in the interior of the plastic tube (2). The plug (3) has two spaced apart axial holes (4*a*) and (4*b*) extending through it, and forms the base of an electric igniter.

Terminal pads (5*a*) and (5*b*) are located on one major surface (6*a*) of the plug (3), each pad coinciding with a corresponding hole (4*a*) and (4*b*). The interior walls of the holes (4*a*) and (4*b*) are covered with a conductive coating (not shown), the coating being in galvanic connection with a corresponding conducting pad (5*a*) and (5*b*).

Terminal pins (7*a*) and (7*b*) are inserted each in a respective hole (4*a*) and (4*b*) to provide electrical continuity between the conductive pads (5*a*) and (5*b*), and the opposing major side (6*b*) of the plug (3).

A resistive bridge element (8) is located on the surface of the plug (3) and is serially connected to the conducting pads (5*a*) and (5*b*) . The resistive bridge element (8) is centrally located on the surface of the plug (3). An annular "vee" section groove (9) in the surface (6*a*) surrounds the bridge element and pads to form an ignition area. The surface (6*b*) of plug (3) has two parallel, spaced apart walls (10) straddling the holes (4*a*) and (4*b*) on that side. The terminal pins (4*a*) and (4*b*) have laterally biased leaves which clip against the walls when the pins are inserted into the holes, and form clip contacts for receiving contact pads on a printed circuit board (pc6).

The cylinder (2) is open at one end (11) and has an end wall (12) at the other end, with a concentric passage (13) extending therefrom through a nozzle (14) of smaller diameter than that of the tube. An elongate cap (15) fits tightly over the nozzle leaving an interior space (16) in the cap, next to the end of the nozzle.

The bridge element (8) is coated with a conflagration charge (8*a*), which is also known as a "spike". A primary and intermediate explosive charge (18) (shown diagrammatically), is located in the passage (13) of the nozzle (14), with a small air gap between it and the conflagration charge. The tube end (12) is closed by the cap (15) which contains a secondary explosive charge (19).

The plug (3) consists of a circular disk substrate molded in poly-butylene terephthalate (PBT) which is reinforced with glass fiber or is glass filled, and which serves as the separating barrier between electronic timing and firing circuitry (20) on a printed circuit board, and the explosive charges (18) and (19) within the detonator. A number of plugs (3) may be simultaneously molded together by means of an injection molding machine. This method of manufacture enables the production of plugs with a consistent surface texture.

The conductive pads (5*a*) and (5*b*) are screen printed over the surface (6*a*) of the plug. During the process of screen printing the pads over the terminals holes (4*a*) and (4*b*), vacuum is applied to the reverse side (6*b*) of the plug (3), so that conductive ink is drawn through the holes to coat the hole walls. The resistive bridge element (8) is created by a screen printing operation in which resistive ink is applied to form the bridge element between the two conductive pads (5*a*) and (5*b*).

The terminal pins (7*a*) and (7*b*) are pressed into the coated holes (4*a*) and (4*b*) from the opposite side of the plug (3), and the plug with its associated circuitry, is operatively positioned in the tube (2). The printed circuit board (20) is plugged into contact with pins (4*a*) and (4*b*) between the walls (10), from the tube end (11).

The conflagration charge which is to coat the bridge element (8) is applied in liquid form through the passage (13) of the nozzle (14), and is confined to the area surrounding the bridge wire element, by the surrounding groove (9), which has dimensions that are empirically selected to cause sufficient surface tension to prevent the charge from spreading beyond the groove. The charge dries relatively quickly, so as not to delay assembly. The conflagration charge may be fixed, in any suitable way, before the igniter is positioned in the tube although this is not the preferred method.

The primary charge is added after the plug is coated, and the cap, with the secondary charge, is glued over the nozzle.

The assembly sequence allows the most dangerous secondary charge to be added as a last step. This avoids assembly handling of the detonator when loaded with a secondary and then a primary charge before the initiating charge is added.

It has been found in practice that the high dielectric strength of the plastics material tube results in good protection of the detonator against spurious detonation by electrostatic charge. Detonators according to this embodiment have been tested safely up to 50,000 V of electrostatic charge. The transparency of the tube allows overall visual inspection of the detonator during assembly and thereafter.

The functioning time of the detonator, as well as the firing levels can be altered by adjusting any combination of the geometry of the screen printed bridge element (7), the characteristics of the material used for the conflagration charge and, the characteristics of the material used to construct the plug (3).

Numerous modifications are possible to the above embodiment without departing from the scope of the invention. For example, the tube (2) and the nozzle (14) may be molded as separate pieces instead of being a single unit.

What I claim as new and desire to secure by Letters Patents is:

1. A method of assembling a detonator comprising:

fitting an electric igniter having an ignition area with a conflagration charge thereon within a tubular body having open first and second ends, so that the said ignition area is accessible from the first end, the electric igniter being fitted by insertion thereof from the second end;

locating a primary explosive charge in operative proximity to the conflagration charge by insertion thereof through the first end; and locating a secondary explosive charge in operative proximity to the primary explosive charge by fitting a tubular extension containing the secondary explosive charge over the said first end.

2. A method as claimed in claim 1, in which the electric igniter is fitted to abut against a constriction in the tube diameter towards the first end.

3. A method as claimed in claim 2, in which the conflagration charge is located by the deposition thereof in liquid form, and the spread of the liquid conflagration charge is contained within the ignition area by use of a containment means therearound.

4. A method as claimed in claim 3, in which the containment means used is a channel in the surface of the electric igniter around the ignition area.

5. A method as claimed in claim 2, in which the first end is sealed after location of the secondary charge.

6. A method as claimed in claim 5, in which the sealing is achieved by means of an end cap fixed over a protruding nozzle forming part of the tube constriction.

7. A method as claimed in claim 6, in which the end cap forms the tubular extension of the first end, and the secondary explosive charge is located therein prior to fixing of the end cap over the nozzle.

8. A method as claimed in claim 1, in which electronic circuitry on a mounting platform is plugged into electrical contact with the electric igniter after insertion of the platform from the second end, and is housed within the tubular body.

9. A detonator comprising:

a generally tubular body having an insertion end and another closable end, the insertion end being formed by a reduced diameter constriction generally concentric with the remainder of the tubular body;

an end cap fixed over the constriction and having a tubular body which when operatively fixed extends the tubular housing;

an electric igniter with a conflagration charge inserted into the tube through the said closable end to abut the said constriction; and a primary explosive charge operatively located within the constriction and next to the electric igniter, and a secondary explosive charge operatively located next to the primary conflagration and within the end cap.

10. A detonator as claimed in claim 9, in which the electric igniter includes electronic circuitry located within the tubular body to extend from the position of the electric igniter towards said other closable end.

11. A detonator as claimed in claim 10, in which the tubular body is a plastics material.

12. A detonator as claimed in claim 11, further comprising an end piece which is also a plastics material.

13. A detonator as claimed claim 11, in which the plastics material is polycarbonate.

14. A detonator as claimed in claim 11, in which the plastics material is at least translucent.

15. An electric igniter comprising a base with two opposed surfaces, there being spaced apart electrically conductive areas on a first surface, and a hole leading from each conductive area to the second surface, each hole being plated through with electrically conductive material to be electrically connected to its respective area, the conductive areas being formed by screen printing of conductive ink on the first surface, and the through plating being achieved by applying a vacuum to the hole at the second surface to draw ink down and coat the sides of the holes.

16. An electric igniter as claimed in claim 15, further comprising a disc which is glass-filled poly-butylene terephthalate.

17. An electric igniter as claimed in claim 15, in which there is a resistive bridge connecting the conductive areas.

18. An electric igniter as claimed in claim 15, in which there is containment means on the first surface surrounding both conductive areas to define an enclosed containment area, the containment means being arranged to contain flowable charge substance within the area, when the charge substance is deposited thereon from overhead in use.

19. An electric igniter as claimed in claim 18, in which the containment means is formed by a groove in the first surface which defines the containment area, the groove dimensions being selected to cause sufficient surface tension in the flowable charge substance to halt the flow thereof in use at the groove position.

20. An electric igniter as claimed in claim 19, in which the groove has a "vee" shaped section.

* * * * *